US005899525A

United States Patent [19]

Tseng

[11] Patent Number: 5,899,525

[45] Date of Patent: May 4, 1999

[54] FOLDABLE CHAIR FRAME

[75] Inventor: Chuen-Jong Tseng, Chiayi Hsien, Taiwan

[73] Assignee: Shin Yen Enterprise Co., Ltd., Chiayi Hsien, Taiwan

[21] Appl. No.: 09/106,671

[22] Filed: Jun. 29, 1998

[51] Int. Cl.[6] ..... A47C 4/00; A47D 1/02

[52] U.S. Cl. ..... 297/51; 297/16.1; 297/31; 297/53; 297/378.12

[58] Field of Search ..... 297/51, 16.1, 378.12, 297/52, 53, 376, 31

[56] References Cited

U.S. PATENT DOCUMENTS

| | | | |
|---|---|---|---|
| 2,708,962 | 5/1955 | Rechler | 297/31 |
| 2,943,672 | 7/1960 | Hook et al. | 297/31 |
| 3,292,830 | 12/1966 | Mack | 297/31 X |
| 4,514,009 | 4/1985 | Vanderminden | 297/16.1 X |
| 4,541,666 | 9/1985 | Vanderminden | 297/16.1 |
| 4,889,383 | 12/1989 | Jones | 297/16.1 |
| 5,054,848 | 10/1991 | Liu | 297/16.1 X |
| 5,058,949 | 10/1991 | Von Hoffman | 297/378.12 X |
| 5,139,308 | 8/1992 | Ziman | 297/31 X |
| 5,498,054 | 3/1996 | Tomlinson | 297/53 X |
| 5,588,696 | 12/1996 | Jay et al. | 297/31 X |

*Primary Examiner*—Peter M. Cuomo
*Assistant Examiner*—Rodney B. White
*Attorney, Agent, or Firm*—Ladas & Parry

[57] ABSTRACT

A foldable chair frame includes a seat frame, a front leg frame, a backrest frame with two lateral rods mounted pivotally to the seat frame, and an armrest frame with two armrest bars disposed adjacent to opposite lateral sides of the seat frame. Each of the armrest bars has a front section which extends forwardly of the backrest frame, and a rear section which extends downwardly from the front section and which is mounted pivotally to a rear end portion of the seat frame posterior to the backrest frame. A locking unit includes a locking seat fixed to one of the armrest bars and formed with an engaging hole, and a locking member having a ring portion sleeved rotatably and slidably on an adjacent one of the lateral rods, and a radial outward latch projection which is provided with a downwardly extending insert section. The locking member is movable on the lateral rod so as to engage the insert section within the engaging hole in order to position the chair frame in an unfolded state, and so as to disengage the insert section from the engaging hole in order to permit folding of the chair frame.

2 Claims, 3 Drawing Sheets

FOLDABLE CHAIR FRAME

BACKGROUND OF THE INVENTION

1. Field of the Invention

This invention relates to a foldable chair frame, more particularly to a foldable chair frame which is provided with a locking unit to prevent untimely folding of the chair frame.

2. Description of the Related Art

Foldable chair frames provided with locking devices or positioning devices to prevent untimely folding of the chair frames are known in the art. In U.S. Pat. No. 5,735,570, there is disclosed a foldable chair frame which is provided with positioning devices to prevent untimely folding of the chair frame. The chair frame disclosed in the aforesaid U.S. patent includes a back frame, a seat frame, front and rear legs, and a pair of armrests. The positioning devices on the chair frame are operable to arrest relative movement between the rear legs and the back frame so as to position the chair frame in an unfolded state for enhanced user safety.

SUMMARY OF THE INVENTION

The main object of the present invention is to provide a foldable chair frame with a locking unit for positioning the chair frame in an unfolded state to prevent untimely folding of the chair frame.

Accordingly, the foldable chair frame of the present invention includes a seat frame, a front leg frame, a backrest frame, an armrest frame, and a locking unit. The seat frame has front and rear end portions. The front leg frame extends downwardly from the front end portion of the seat frame, and has an upper end mounted pivotally to the front end portion of the seat frame. The backrest frame includes a parallel pair of lateral rods, each of which has a lower end mounted pivotally to the rear end portion of the seat frame. The armrest frame includes a parallel pair of armrest bars disposed adjacent to opposite lateral sides of the seat frame. Each of the armrest bars has a front section which extends forwardly of a respective one of the lateral rods of the backrest frame, and a rear section which extends downwardly from the front section and which is mounted pivotally to the rear end portion of the seat frame posterior to the respective one of the lateral rods of the backrest frame. The rear sections of the armrest bars cooperatively serve as a rear leg frame. The chair frame is movable between an unfolded state, in which the lateral rods of the backrest frame are substantially upright, the seat frame and the front sections of the armrest bars are substantially horizontal, and the front sections of the armrest bars are disposed above the seat frame, and a folded state, in which the backrest frame, the seat frame and the armrest bars are substantially upright, and the rear sections of the armrest bars extend rearwardly and downwardly from the front sections. The locking unit includes a locking seat and a locking member. The locking seat is fixed to one of the armrest bars and is disposed adjacent to one of the lateral rods of the backrest frame. The locking seat has a plate portion formed with an engaging hole. The locking member has a ring portion sleeved rotatably and slidably on the adjacent one of the lateral rods of the backrest frame, and a radial outward latch projection which projects from the ring portion and which is provided with a downwardly extending insert section that is substantially parallel to the adjacent one of the lateral rods of the backrest frame. The locking member is movable on the adjacent one of the lateral rods so as to engage the insert section within the engaging hole of the locking seat in order to position the chair frame in an unfolded state, and so as to disengage the insert section from the engaging hole of the locking seat in order to permit folding of the chair frame.

BRIEF DESCRIPTION OF THE DRAWINGS

Other features and advantages of the present invention will become apparent in the following detailed description of the preferred embodiment with reference to the accompanying drawings, in which.

DETAILED DESCRIPTION OF THE PREFERRED EMBODIMENT

Figure 1:
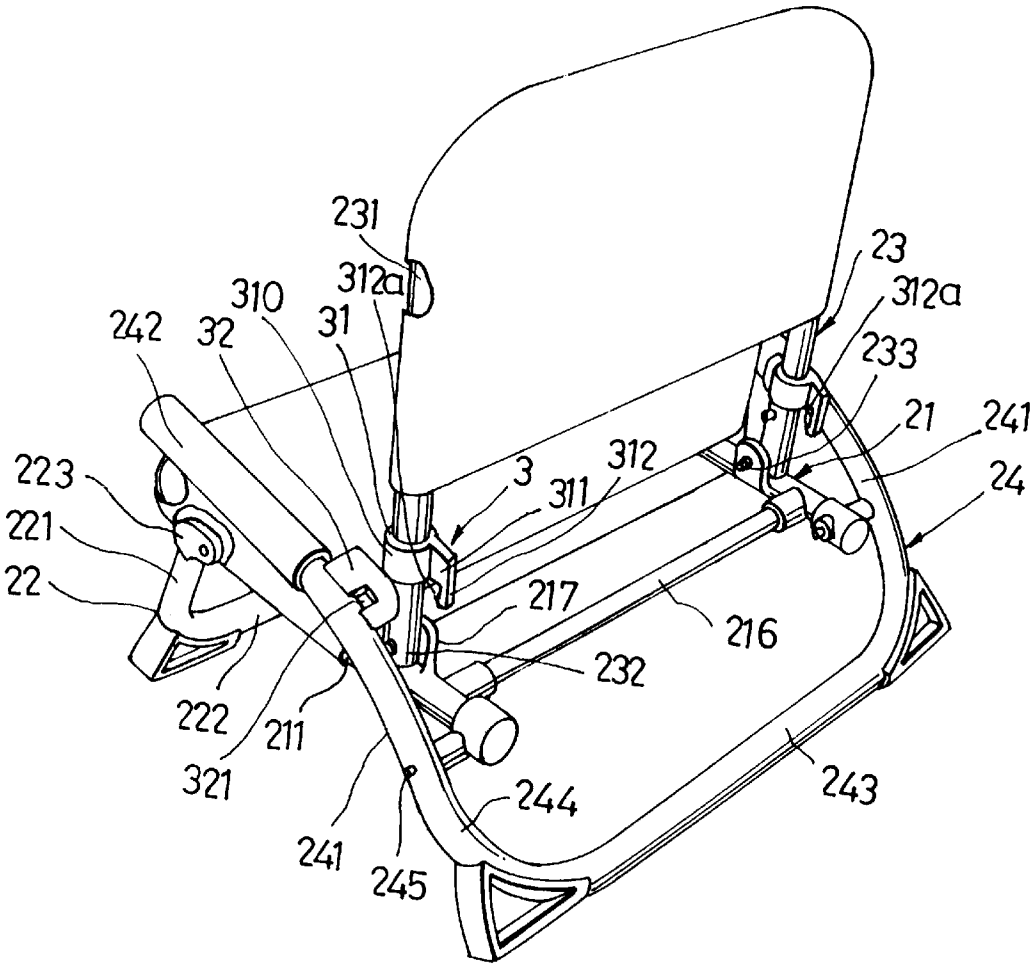
FIG. 1 is a rear perspective view illustrating a preferred embodiment of a foldable chair frame according to the present invention when in an unfolded state while two locking units thereof are unlocked.
Figure 2:
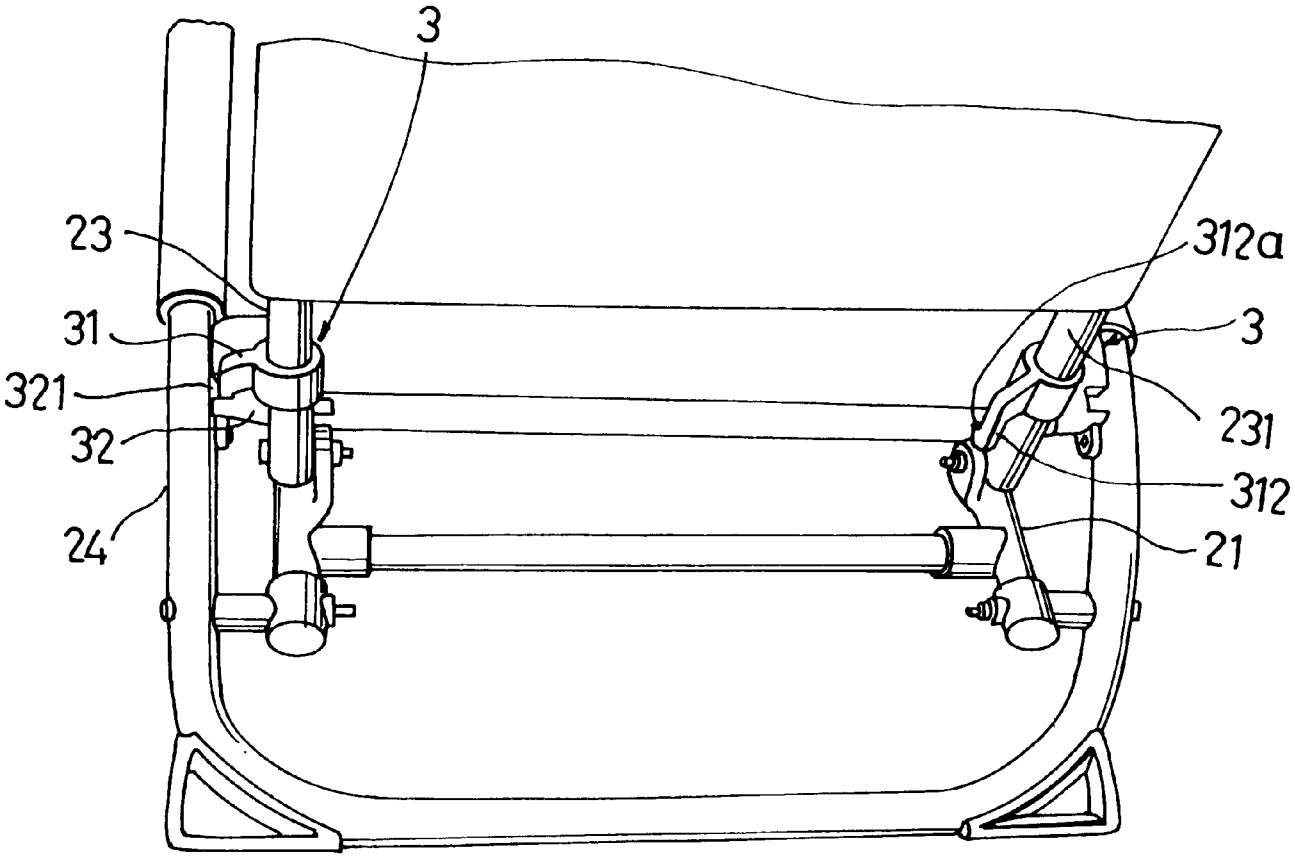
FIG. 2 is a fragmentary rear perspective view of the preferred embodiment when in an unfolded state while only one of the locking units is locked.

Referring to FIGS. 1 and 2, the foldable chair frame of the preferred embodiment according to the present invention is shown to generally include a seat frame 21, a front leg frame 22, a backrest frame 23, an armrest frame 24, and a pair of locking units 3.

The seat frame 21 includes a parallel pair of lateral rails 211, each of which has front and rear end portions, and a transverse connecting rod 216 interconnecting the rear end portions of the lateral rails 211. The rear end portion of each of the lateral rails 211 is provided with an upward pivot lobe 217.

The front leg frame 22 is formed as a U-shaped rod with two parallel upwardly extending sections 221 and a horizontal section 222 which interconnects lower ends of the upwardly extending sections 221 and which is adapted to be supported on a ground surface. Each of the upwardly extending sections 221 has an upper end mounted pivotally to the front end portion of a respective one of the lateral rails 211 by means of a pivot seat 223 which is capable of retaining the front leg frame 22 in an unfolded state, in which the upwardly extending sections 221 extend downwardly and respectively from the front end portions of the lateral rails 211 of the seat frame 21, and in which the horizontal section 222 is supported on the ground surface.

The backrest frame 23 includes a parallel pair of lateral rods 231, each of which has a lower end 232 that extends adjacent to the pivot lobe 217 formed on the rear end portion of a respective one of the lateral rails 211 of the seat frame 21. A first pivot pin 233 extends through the lower end 232 of a respective one of the lateral rods 231 and through the adjacent one of the pivot lobes 217 for mounting pivotally the lower end 232 of the lateral rod 231 to the rear end portion of the adjacent lateral rail 211 of the seat frame 21. The backrest frame 23 is thus movable pivotally relative to the seat frame 21 about the first pivot pins 233.

The armrest frame 24 includes a parallel pair of armrest bars 241 disposed adjacent to opposite lateral sides of the lateral rails 211 of the seat frame 21. Each of the armrest bars 241 includes a front section 242 which extends forwardly of a respective one of the lateral rods 231 of the backrest frame 23, and a rear section 244 which extends rearwardly and downwardly from the front section 242 and which is mounted pivotally to the rear end portion of an adjacent one of the lateral rails 211 of the seat frame 21 by means of a second pivot pin 245. As shown, the second pivot pins 245 are disposed posteriorly of the first pivot pins 233 and the lateral rods 231 of the backrest frame 23. A rear connecting rod 243 interconnects the rear sections 244 of the armrest bars 241 and is adapted to be supported on the ground surface. The rear connecting rod 243 and the rear sections 244 of the armrest bars 241 cooperatively serve as a rear leg frame.

When the chair frame is in an unfolded state, the lateral rods 231 of the backrest frame 23 are substantially upright, the seat frame 21 and the front sections 242 of the armrest bars 241 are substantially horizontal, and the front sections 242 of the armrest bars 241 are disposed above the seat frame 21.

Figure 3:
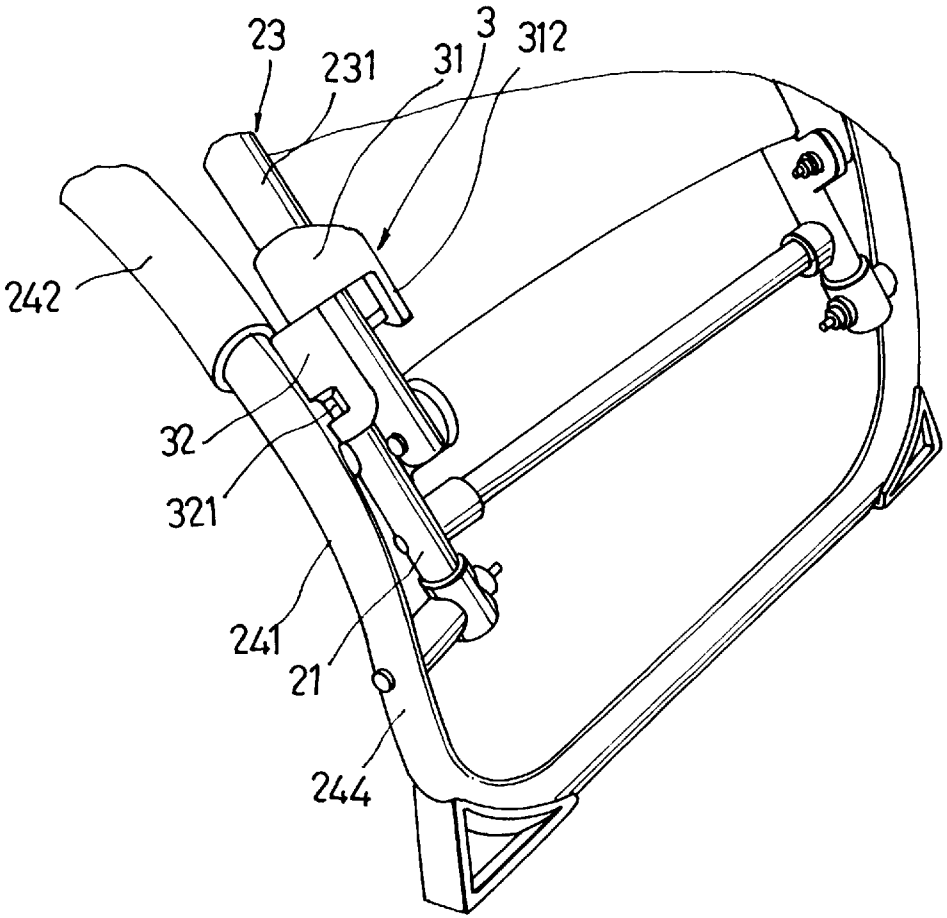
FIG. 3 is a fragmentary rear perspective view illustrating the preferred embodiment when in a folded state.

When the chair frame is in a folded state, as shown in FIG. 3, the seat frame 21, the backrest frame 23 and the armrest bars 241 are substantially upright, and the rear sections 244 of the armrest bars 241 extend rearwardly and downwardly from the front sections 242.

Referring again to FIGS. 1 and 2, the locking units 3 are provided on two lateral sides of the chair frame. Each of the locking units 3 includes a locking seat 32 and a locking member 31. The locking seat 32 is fixed to one of the armrest bars 241, and is disposed adjacent to one of the lateral rods 231 of the backrest frame 23. The locking seat 32 is formed as a rectangular plate with an engaging hole 321. When the chair frame is in the unfolded state shown in FIG. 1, the locking seat 32 is substantially horizontal. The locking member 31 has a ring portion 310 sleeved rotatably and slidably on the adjacent one of the lateral rods 231 of the backrest frame 23, and a radial outward latch projection 311 which projects from the ring portion 310 and which has a downwardly extending insert section 312 that is substantially parallel to the adjacent one of the lateral rods 231 of the backrest frame 23. The insert section 312 has a hooked distal end 312*a*.

To unfold the chair frame, the seat frame 21 is stretched forwardly relative to the backrest frame 23 so that the locking seats 32 of the locking units 3 are disposed adjacent to the locking members 31, respectively, and the front leg frame 22 is turned forwardly relative to the seat frame 21 to be supported on the ground surface. Thereafter, the locking member 31 of each of the locking units 3 is operated to rotate about and slide downwardly along the corresponding lateral rod 231 so that the insert section 312 of the locking member 31 can be extended into the engaging hole 321 of the adjacent locking seat 32 and so that the hooked distal end 312*a* of the locking member 31 of each of the locking unit 3 can engage a bottom side of the adjacent locking seat 32. Thus, by locking the armrest bars 241 to the lateral rods 231 of the backrest frame 23, respectively, the chair frame can be positioned in the unfolded state. The hooked distal ends 312*a* which engage the bottom sides of the locking seats 32 prevent unforced removal of the insert sections 312 from the engaging holes 321 in order to position the chair frame securely in the unfolded state.

Referring to FIG. 3, to fold the chair frame, the locking member 31 of each of the locking units 3 is operated once again to slide upwardly along and to rotate about the corresponding lateral rod 231 for removal of the insert section 312 from the engaging hole 321 of the adjacent locking seat 32. Thereafter, the seat frame 21 is folded on the backrest frame 23, and the front leg frame 22 (see FIG. 1) is folded on the seat frame 21 to complete folding of the chair frame.

Accordingly, with the provision of the locking seat 32 which is formed with an engaging hole 321, and the locking member 31 which has a downwardly extending insert section 312 that is extendible into the engaging hole 321, the armrest bars 241 of the chair frame can be locked to the backrest frame 23 when the chair frame is in an unfolded state. In this manner, the foldable chair frame of the present invention can be prevented from untimely folding in a simple yet effective manner. The object of the present invention is thus met.

With this invention thus explained, it is apparent that numerous modifications and variations can be made without departing from the scope and spirit of this invention. It is therefore intended that this invention be limited only as indicated in the appended claims.

I claim:

1. A foldable chair frame, comprising:

a seat frame having front and rear end portions;

a front leg frame which extends downwardly from said front end portion of said seat frame and which has an upper end mounted pivotally to said front end portion of said seat frame;

a backrest frame including a parallel pair of lateral rods, each of which has a lower end mounted pivotally to said rear end portion of said seat frame;

an armrest frame including a parallel pair of armrest bars disposed adjacent to opposite lateral sides of said seat frame, each of said armrest bars having a front section which extends forwardly of a respective one of said lateral rods of said backrest frame, and a rear section which extends downwardly from said front section and which is mounted pivotally to said rear end portion of said seat frame posterior to the respective one of said lateral rods of said backrest frame, said rear sections of said armrest bars cooperatively serving as a rear leg frame;

said chair frame being movable between an unfolded state, in which said lateral rods of said backrest frame are substantially upright, said seat frame and said front sections of said armrest bars are substantially horizontal, and said front sections of said armrest bars are disposed above said seat frame, and a folded state, in which said backrest frame, said seat frame and said armrest bars are substantially upright, and said rear sections of said armrest bars extend rearwardly and downwardly from said front sections; and a locking unit which includes:

a locking seat fixed to one of said armrest bars and disposed adjacent to one of said lateral rods of said backrest frame, said locking seat having a plate portion formed with an engaging hole; and a locking member having a ring portion sleeved rotatably and slidably on said adjacent one of said lateral rods of said backrest frame, and a radial outward latch projection which projects from said ring portion and which is provided with a downwardly extending insert section that is substantially parallel to said adjacent one of said lateral rods of said backrest frame, said locking member being movable on said adjacent one of said lateral rods so as to engage said insert section within said engaging hole of said locking seat in order to position said chair frame in an unfolded state, and so as to disengage said insert section from said engaging hole of said locking seat in order to permit folding of said chair frame.

2. The foldable chair frame according to claim 1, wherein said insert section has a hooked distal end for engaging a bottom side of said plate portion of said locking seat when said insert section is extended into said engaging hole of said locking seat so as to prevent unforced removal of said insert section from said engaging hole.

* * * * *